US010403258B2

(12) United States Patent
Zafeiropoulos

(10) Patent No.: US 10,403,258 B2
(45) Date of Patent: Sep. 3, 2019

(54) SILENT ZONE GENERATION

(71) Applicant: Harman Becker Automotive Systems GmbH, Karlsbad (DE)

(72) Inventor: Nikos Zafeiropoulos, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 16/073,755

(22) PCT Filed: Jul. 28, 2017

(86) PCT No.: PCT/EP2017/069189
§ 371 (c)(1),
(2) Date: Jul. 27, 2018

(65) Prior Publication Data

US 2019/0035380 A1 Jan. 31, 2019

(51) Int. Cl.
*G10K 11/178* (2006.01)
*H04R 1/10* (2006.01)

(52) U.S. Cl.
CPC .... *G10K 11/17817* (2018.01); *G10K 11/1781* (2018.01); *G10K 11/17857* (2018.01);
(Continued)

(58) Field of Classification Search
CPC ..... G10K 11/17817; G10K 2210/1082; G10K 2210/3027; G10K 11/167857; H04R 1/1083
See application file for complete search history.

(56) References Cited

U.S. PATENT DOCUMENTS

2017/0150256 A1* 5/2017 Christoph ..... H04R 3/005

FOREIGN PATENT DOCUMENTS

CN 106251855 A 12/2016
EP 2840568 A1 2/2015
(Continued)

OTHER PUBLICATIONS

Kaiser, "Model Analysis of Rigid Microphone Arrays using Boundary Elements", Institute of Electronic Music and Acoustics, University of Music and Performing Arts, Graz, Austria, Jun. 2012, 83 pages.

(Continued)

*Primary Examiner* — Regina N Holder
(74) *Attorney, Agent, or Firm* — Brooks Kushman P.C.

(57) ABSTRACT

A system for generating a silent zone at a listening position is provided. The system includes a loudspeaker, an error microphone, a microphone array, and a noise controller. The loudspeaker is configured to radiate sound that corresponds to a sound signal. The error microphone is configured to pick up noise radiated by a noise source and the sound radiated by the loudspeaker via a secondary path. The microphone array is configured to pick up noise radiated by a noise source and the sound from the loudspeaker. The microphone array is configured to generate corresponding array signals. The noise controller is configured to receive a noise signal representative of noise radiated by the noise source and to filter the noise signal with a controllable noise reduction transfer function. The noise controller is further configured to control the noise reduction transfer function based on the noise signal and a virtual error signal.

20 Claims, 2 Drawing Sheets

(52) U.S. Cl.
CPC ... *H04R 1/1083* (2013.01); *G10K 2210/1082* (2013.01); *G10K 2210/3027* (2013.01); *G10K 2210/3055* (2013.01)

(56) References Cited

FOREIGN PATENT DOCUMENTS

| | | | |
|---|---|---|---|
| EP | 2930958 | A1 | 10/2015 |
| WO | 02091353 | A1 | 11/2002 |

OTHER PUBLICATIONS

Bean et al., "Hybrid Feedforward-Feedback Noise Control using Virtual Sensors", Noise-Con, Providence, Rhode Island, Jun. 13-15, 2016, 14 pages.
Jensen et al., "Chapter 2, Wave Propagation Theory", Computational Ocean Acoustics, Modern Acoustics and Signal Processing, Springer Science+Business Media, LLC, 2011, 90 pages.
Xiang et al., "Sound source identification in a noisy environment based on inverse patch transfer functions with evanescent Green's functions", Journal of Sound and Vibration, vol. 359, Sep. 16, 2015, pp. 68-83.

* cited by examiner

SILENT ZONE GENERATION

CROSS-REFERENCE TO RELATED APPLICATION

This application is the U.S. national phase of PCT Application No. PCT/EP2017/069189 filed on Jul. 28, 2017, the disclosure of which is incorporated in their entirety by reference herein.

BACKGROUND

1. Field

The disclosure relates systems and methods (generally referred to as "systems") for the generation of a silent zone.

2. Related Art

When used in user-related applications, microphones should be positioned as close as possible to the user's head to provide superior acoustic properties. However, many environments such as, e.g., the interiors of vehicles hardly or even do not at all allow positioning of microphones close to the head. In some applications, the microphone is therefore mounted on a flexible arm, hinged holder, rigid boom, pivotable or extendable wing, or the like, extending into the direction of the user, but such arrangements are inconvenient and may bear significant risk of user injury, particularly in the case of a vehicle crash. Increased acoustic properties without deteriorating convenience and safety are desirable.

SUMMARY

A system for generating a silent zone at a listening position includes a loudspeaker disposed adjacent to the listening position and configured to radiate sound that corresponds to a sound signal, and an error microphone disposed adjacent to the listening position and configured to pick up noise radiated by a noise source via a primary path to the listening position and the sound radiated by the loudspeaker via a secondary path to the listening position, and configured to generate a corresponding error signal. The system further includes a microphone array comprising a multiplicity of array microphones disposed above the listening position and configured to pick up noise radiated by a noise source via a primary path to the listening position and the sound radiated by the loudspeaker via a secondary path, and configured to generate corresponding array microphone signals. The system further includes a noise controller configured to receive a noise signal representative of noise generated by the noise source and to filter the noise signal with a controllable noise reduction transfer function to generate the sound signal supplied to the loudspeaker. The noise controller is further configured to control the noise reduction transfer function based on the noise signal and a virtual error signal, and configured to generate the virtual error signal based on the error signal and the noise signal filtered with a Green's function matrix, the Green's function matrix being configured to be controlled dependent on the array signals.

A method for generating a silent zone at a listening position includes radiating, with a loudspeaker disposed adjacent to the listening position, sound that corresponds to a sound signal, and picking up, with an error microphone disposed adjacent to the listening zone, noise radiated by a noise source via a primary path to the listening position and the sound radiated by the loudspeaker via a secondary path to the listening position, and generating a corresponding error signal. The method further includes picking up, with a microphone array comprising a multiplicity of array microphones disposed above the listening position, noise radiated by a noise source via a primary path to the listening position and the sound radiated by the loudspeaker via a secondary path, and generating corresponding array microphone signals. The method further includes controlling noise by receiving a noise signal representative of noise generated by the noise source and filtering the noise signal with a controllable noise reduction transfer function to generate the sound signal supplied to the loudspeaker. Controlling noise further comprises controlling the noise reduction transfer function based on the noise signal and a virtual error signal, and generating the virtual error signal based on the error signal and the noise signal filtered with a Green's function matrix, the Green's function matrix being configured to be controlled dependent on the array signals.

Other systems, methods, features and advantages will be, or will become, apparent to one with skill in the art upon examination of the following detailed description and appended figures. It is intended that all such additional systems, methods, features and advantages be included within this description, be within the scope of the invention, and be protected by the following claims.

BRIEF DESCRIPTION OF THE DRAWINGS

The disclosure may be better understood by reading the following description of non-limiting embodiments of the attached drawings, in which like elements are referred to with like reference numbers, wherein below.

DETAILED DESCRIPTION

Figure 1:
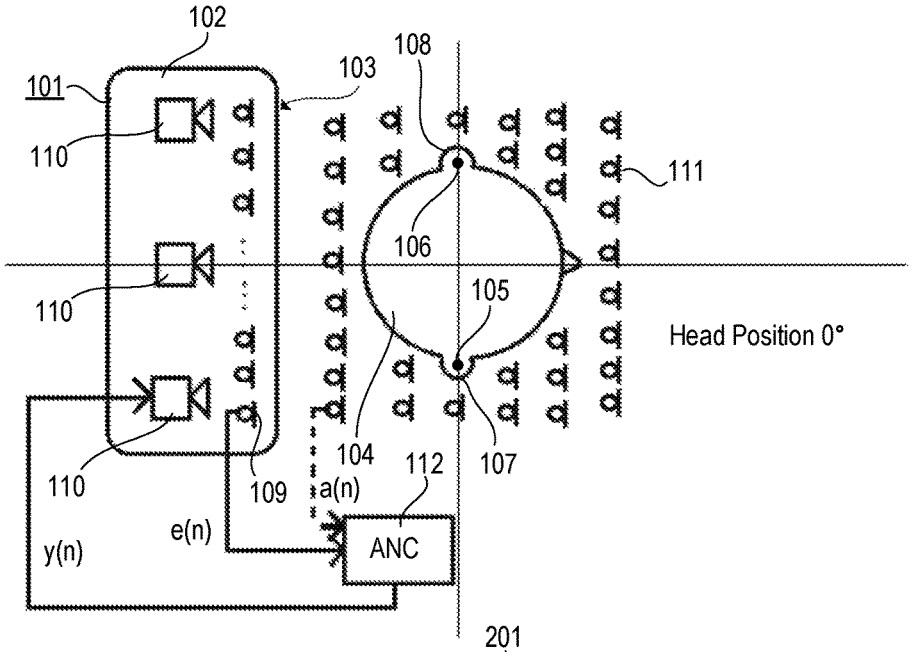
FIG. 1 is a schematic diagram of an exemplary headrest arrangement in which microphones and loudspeakers are integrated side by side in a front surface of a headrest.

FIG. 1 is a top view of an exemplary headrest 101, e.g., a headrest of a seat disposed in a vehicle interior, in a sectional illustration. Headrest 101 may have a cover and one or more structural elements that form a headrest body 102. Headrest 101 may also comprise a pair of support pillars (not shown) that engage the top of a seat (not shown) and may be movable up and down by way of a mechanism integrated in the seat. Headrest body 102 has a front surface 103 that is able to support a listener's head 104, thereby defining preferential positions 105 and 106 of listener's ears 107 and 108. A preferential position, also referred to as listening position, is an area where the respective ear is most of the time (>50%) during intended use.

A number (≥1) of microphones 109, each of which have a direction of maximum sensitivity (ratio of output signal parameter to input sound pressure), are integrated in the front surface 103 of the headrest body 102 and their directions of maximum sensitivity may intersect with the preferential positions 105 and 106 of listener's ears 107 and 108, respectively. Around the preferential positions 105 and 106 or the listener's ears 107 and 108, respectively, quiet zones (areas with less or no noise) are to be established. The headrest 101 further includes a number (≥1) of loudspeakers 110 integrated in the headrest body 102. Loudspeakers 110 may each have principal transmitting directions into which they radiate maximum sound pressure, e.g., in the direction of the listener's head 104.

An array of microphones 111 disposed above the listener's head 104, e.g., in a roof liner of a vehicle interior, measures and feeds back background noise occurring around the headrest 101. Signals output by the array of microphones 111, herein referred to as array signals a(n), are combined with one or more sound signals y(n) supplied to the loudspeakers 110 and one or more error signals e(n) from the microphones 109 embedded in the headrest 101. Virtual array signals, i.e., signals from virtual microphones at virtual microphone positions above the listener's head 104, may be generated by way of a dedicated algorithm or procedure executed by a processor, controller or circuit based on the one or more error signals e(n) from the microphones 109 in the headrest 101. The virtual array signals are representative of the noise occurring at corresponding virtual microphone positions. The algorithm or procedure for generating the virtual array signals and, thus, the virtual microphone positions may be fully adaptive so that it compensates for head movements by adapting the magnitude and phase characteristics of respective control filters implemented in a single or multi-channel active noise control (ANC) processor 112 having a noise control structure that may be feedforward or feedback or a combination thereof.

Figure 2:
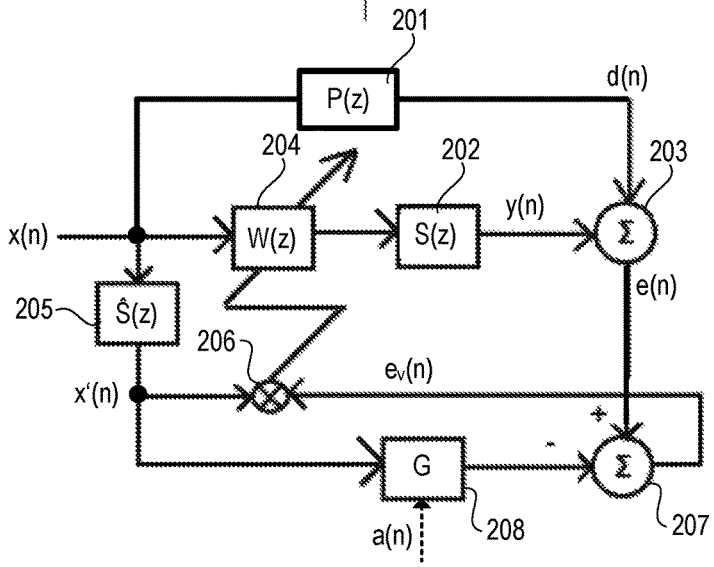
FIG. 2 is a block diagram illustrating an exemplary active noise control structure applicable in connection with the headrest arrangement shown in FIG. 1.

An exemplary single-channel feedforward active noise control structure applicable in the active noise control (ANC) processor 112 in the arrangement shown in FIG. 1 is illustrated in FIG. 2. Noise x(n) from a noise source (not shown) is acoustically transferred via a primary path 201 having a transfer function P(z) to a listening position where it is picked up as a noise signal d(n) by an error microphone (not shown), which may be similar to microphones 109 in the arrangement described above in connection with FIG. 1. The error microphone may also pick up sound originating from a loudspeaker (not shown) and transferred to the listening position via a secondary path 202 having a transfer function S(z) to provide the sound signal y(n) representative of the sound from the loudspeaker at the listening position. The loudspeaker may be similar to loudspeakers 110 in the arrangement described above in connection with FIG. 1. As the transferred sound from the loudspeaker represented by sound signal y(n) and the transferred noise from the noise source represented by noise signal d(n) are superimposed (e.g., summed up) at the listening position, an adder 203 represents the microphone which provides an error signal e(n) representative of the sum of the noise signal d(n) and the sound signal y(n), and, thus, of the sound resulting from when the sound from the loudspeaker and from the noise source interfere with each other at the listening position.

A filter 204 having a controllable transfer function W(z) is connected upstream of the loudspeaker and, thus, the secondary path 202, and downstream of the noise source. The transfer function W(z) of the filter 204 is controlled by an adaptive filter controller which may operate according to the known least mean square (LMS) algorithm based on an virtual error signal $e_v(n)$ and on a filtered noise signal x'(n). In the example shown, the adaptive filter controller is simply a multiplier 206 that multiplies the filtered noise signal x'(n) with the virtual error signal $e_v(n)$. The filtered noise signal x'(n) is the noise signal x(n) after being filtered by a filter 205 having a transfer function $\hat{S}(z)$. The transfer function $\hat{S}(z)$ is an estimate of the transfer function S(z) of the secondary path 202. The virtual error signal $e_v(n)$ is provided by a subtractor 207 based on the difference between the error signal e(n) and the filtered noise signal x'(n) which is the noise signal x(n) filtered by a (filter) matrix 208 which is a Green's matrix, G, i.e., a matrix of Green's functions g. In mathematics, a Green's function is the impulse response of an inhomogeneous linear differential equation defined on a domain, with specified initial conditions or boundary conditions. Through the superposition principle for linear operator problems, the convolution of a Green's function with an arbitrary function on that domain is the solution to the inhomogeneous differential equation for this arbitrary function.

The transfer function W(z) of the filter 204 is controlled such that, at the listening position, the sound signal y(n) has a waveform inverse in phase to that of the noise signal d(n), i.e., the transferred sound from the loudspeaker represented by the sound signal y(n) is destructively superimposed with the transferred noise from the noise source represented by the noise signal d(n). According to the relations outlined above, it is true that in the frequency domain W(z)=−P(z)/S(z) and $\hat{S}(z)=S(z)$.

Filter 204, filter 205 and filter controller 206 are arranged in a single-channel feedforward filtered-x least mean square (FxLMS) control structure but other control structures including multi-channel structures with a multiplicity of noise signals and/or loudspeakers and/or microphones are applicable as well. This filtered-x least mean square control structure can be described in the time domain as follows:

$$w(n+1)=w(n)+\mu\cdot x'(n)\cdot e_v(n),$$

wherein w(n) and w(n+1) in the time domain correspond to W(z) in the frequency domain, n+1 is a discrete point in time subsequent to a discrete point in time n, and μ is a step size which is set to 1 for the sake of simplicity in the exemplary system shown in FIG. 1.

The virtual error signal $e_v$ is generated by filtering the noise signal x(n) with the filter matrix 208, i.e., a matrix of filters that compensate for spatial secondary path effects around the head as follows:

$$e_v=e-g\cdot x'(n),$$

wherein g stands for Green's function while G stands for a Green matrix, e.g., a matrix of filters whose transfer functions have been determined by measuring all possible secondary path transfer functions between the loudspeaker(s) on the one hand and, on the other, the headrest microphone (s), the array of microphones above the listener's head and optionally microphones at other adjacent positions in order to create a sphere of silence around the head.

Figure 3:
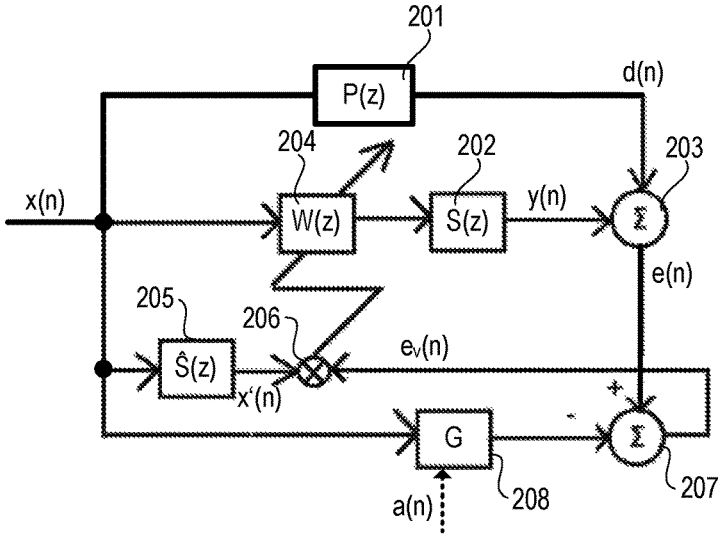
FIG. 3 is a block diagram illustrating another exemplary active noise control structure applicable in connection with the headrest arrangement shown in FIG. 1.

Referring to FIG. 3, the system described above in connection with FIG. 2 may be altered so that alternatively the noise signal x(n) is input directly into the accordingly adapted filter matrix 208 with accordingly adapted Green's matrix G so that now it is true:

$$e_v=e-g\cdot x(n).$$

Once Green's matrix G of the (filter) matrix 208 are determined from all possible secondary path transfer functions, the noise reduction is maximized around the listener's head 104 and not at the microphones 109 in the headrest 101. The microphones 109 are used to determine the actual one or more error signals e(n) for active noise control. The array of microphones 111 provides the array signals a(n) which are used to generate virtual array signals $a_v(n)$.

Figure 4:
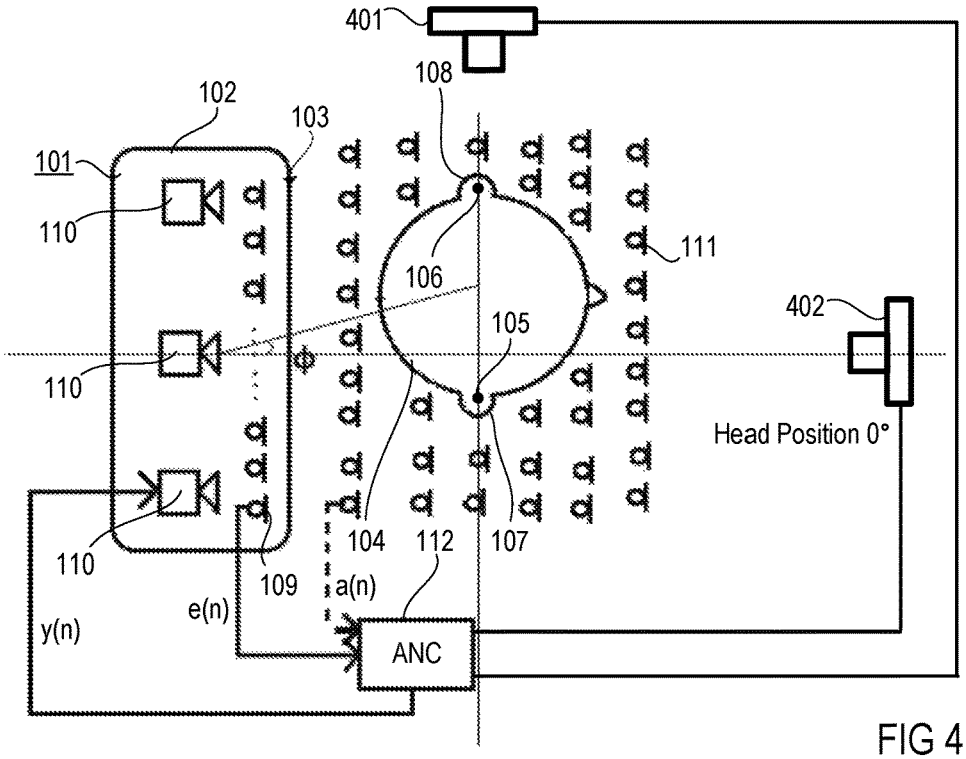
FIG. 4 is a schematic diagram of the exemplary headrest arrangement shown in FIG. 1 with a deviation of an actual head position from a preferential position.

The virtual array signals $a_v(n)$ may be generated by alternatively or additionally taking into account the head movements and subtracting from the initial head position (nominal position of the head) several head position variations. Referring again to FIG. 1, the passenger's head 104 is shown to be in a preferential position, which means that the deviation from the preferential position is 0° from a center of headrest 101. The one or more secondary paths, e.g., consolidated as a secondary path matrix, are measured at the preferential position (with deviation 0°) and, as depicted in FIG. 4, many other possible head positions (with deviations Φ°) in order to compensate for head movements that affect the secondary path matrix. Thereby, the FxLMS algorithm or procedure may be modified in order to compensate for the head movements and, thus, to enlarge the quiet zone area.

The actual position of the listener's head may optionally be determined by way of one or more optical or acoustic sensors. In the arrangement shown in FIG. 4, two cameras 401 and 402 arranged perpendicular to each other are used in connection with an adequate video processing algorithm or procedure (not shown). Thus, a Green's function between the virtual array position and the position of the microphone (s) 109 may be measured. This function may be integrated in the noise control algorithm or procedure in order to predict the virtual error signals $e_v$. The virtual error signals $e_v$ are generated employing a matrix of estimated Green's functions while the filtered noise signal(s) x' and virtual noise signals $x'_v$ may be generated with the actual and virtual secondary paths.

Figure 5:
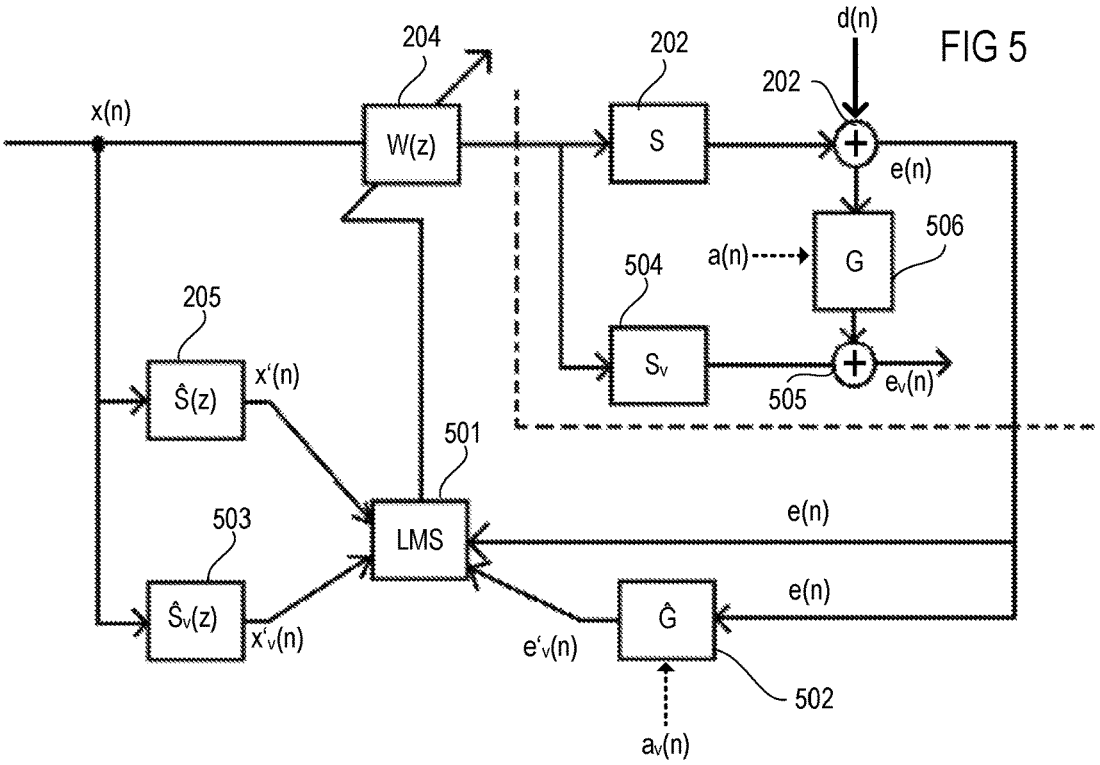
FIG. 5 is a block diagram illustrating another exemplary active noise control structure applicable in connection with the headrest arrangement shown in FIG. 1.

Referring to FIG. 5, an amended noise control structure includes the filter 204 that has the controllable transfer function W(z) and that is connected upstream of the secondary path 202 with transfer function S(z), and the adder 203 representing (one of) the microphones 109 in the headrest 101, which is arranged downstream of the secondary path 202. The adder 203 provides the error signal e(n) which is supplied directly to an adaptive filter controller 501 as well as being filtered by an estimated Green's ($\hat{G}$) matrix 502 providing a filtered virtual error signal $e'_v(n)$ to the adaptive filter controller 501. The adaptive filter controller 501 further receives the noise signal x'(n) which is the noise signal x(n) filtered by filter 205 with the estimated transfer function $\hat{S}(z)$, i.e., the estimate of transfer function S(z) of the secondary path 202, and a noise signal x'(v) which is the noise signal x(n) filtered by a filter 503 with an estimated virtual transfer function $\hat{S}_v(z)$. The estimated virtual transfer function $\hat{S}_v(z)$ is the estimate of a virtual transfer function $S_v(z)$ of a virtual secondary path 504 that transfers the signal output by filter 204 to an adder 505 representative of a virtual microphone. The adder 505 also receives from adder 203 the error signal e(n) filtered with a Green's matrix 506 and provides the virtual error signal $e_v(n)$.

The systems and methods described herein may be used in a multiplicity of applications and environments such as, for example, in living areas and in interiors of vehicles to generate dedicated silent or sound zones. Beside general noise control, the system and methods described herein are also applicable in specific control situations such as road noise control in land-based vehicles or engine order cancellation in combustion engine driven vehicles.

The description of embodiments has been presented for purposes of illustration and description. Suitable modifications and variations to the embodiments may be performed in light of the above description or may be acquired by practicing the methods. For example, unless otherwise noted, one or more of the described methods may be performed by a suitable device and/or combination of devices. The described associated actions may also be performed in various orders in addition to the order described in this application, in parallel, and/or simultaneously. The described systems are exemplary in nature, and may include additional elements and/or omit elements.

As used in this application, an element or step recited in the singular and preceded by the word "a" or "an" should be understood as not excluding the plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

The embodiments of the present disclosure generally provide for a plurality of circuits, electrical devices, and/or at least one controller. All references to the circuits, the at least one controller, and other electrical devices and the functionality provided by each, are not intended to be limited to encompassing only what is illustrated and described herein. While particular labels may be assigned to the various circuit(s), controller(s) and other electrical devices disclosed, such labels are not intended to limit the scope of operation for the various circuit(s), controller(s) and other electrical devices. Such circuit(s), controller(s) and other electrical devices may be combined with each other and/or separated in any manner based on the particular type of electrical implementation that is desired.

It is recognized that any system as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any system as disclosed may utilize any one or more microprocessors to execute a computer-program that is embodied in a non-transitory computer readable medium that is programmed to perform any number of the functions as disclosed. Further, any controller as provided herein includes a housing and a various number of microprocessors, integrated circuits, and memory devices, (e.g., FLASH, random access memory (RAM), read only memory (ROM), electrically programmable read only memory (EPROM), and/or electrically erasable programmable read only memory (EEPROM).

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

The invention claimed is:

1. A system for generating a silent zone at a listening position, the system comprising:

a loudspeaker disposed adjacent to the listening position and configured to radiate sound that corresponds to a sound signal;

an error microphone disposed adjacent to the listening position and configured to pick up noise radiated by a noise source via a primary path to the listening position and the sound radiated by the loudspeaker via a secondary path to the listening position, and configured to generate a corresponding error signal;

a microphone array comprising a multiplicity of array microphones disposed above the listening position and configured to pick up noise radiated by a noise source via a primary path to the listening position and the sound radiated by the loudspeaker via a secondary path, the microphone array being configured to generate corresponding array signals; and a noise controller configured to receive a noise signal representative of noise radiated by the noise source and to filter the noise signal with a controllable noise reduction transfer function to generate the sound signal supplied to the loudspeaker, wherein the noise controller is further configured to control the noise reduction transfer function based on the noise signal and a virtual error signal, and configured to generate the virtual error signal based on the error signal and the noise signal filtered with a Green's function matrix, the Green's function matrix being configured to be controlled by the array signals.

2. The system of claim 1, wherein the noise controller is further configured to subtract from the error signal the noise signal filtered with a Green's function matrix to generate the virtual error signal.

3. The system of claim 1, wherein the noise controller is further configured to control the noise reduction transfer function according to a least mean square scheme based on the noise signal and the virtual error signal.

4. The system of claim 1, wherein the noise controller is further configured to filter the noise signal with a transfer function that models a transfer function of the secondary path prior to the noise controller controlling the noise reduction transfer function.

5. The system of claim 1, wherein the noise controller is further configured to filter the noise signal with a transfer function that models a transfer function of the secondary path prior to the noise signal being filtered with the Green's function matrix.

6. The system of claim 1, further comprising a position detector configured to detect a position of a listener and to control the Green's function matrix according to the detected position.

7. The system of claim 1, wherein at least one of the loudspeaker or the error microphone is disposed in a headrest.

8. A method for generating a silent zone at a listening position, the method comprising:

radiating with a loudspeaker disposed adjacent to the listening position, sound that corresponds to a sound signal;

picking up with an error microphone disposed adjacent to the listening position, noise radiated by a noise source via a primary path to the listening position and the sound radiated by the loudspeaker via a secondary path to the listening position, generating, with the error microphone, a corresponding error signal;

picking up with a microphone array comprising a multiplicity of array microphones disposed above the listening position, noise radiated by a noise source via a primary path to the listening position and the sound radiated by the loudspeaker via a secondary path to the listening position, generating, with the microphone array, corresponding array signals; and controlling noise by receiving a noise signal representative of noise generated by the noise source and filtering the noise signal with a controllable noise reduction transfer function to generate the sound signal supplied to the loudspeaker, wherein controlling noise further comprises controlling the noise reduction transfer function based on the noise signal and a virtual error signal, and generating the virtual error signal based on the error signal and the noise signal filtered with a Green's function matrix, the Green's function matrix being configured to be controlled by the array signals.

9. The method of claim 8, wherein controlling noise further comprises subtracting from the error signal the noise signal filtered with a Green's function matrix to generate the virtual error signal.

10. The method of claim 8, wherein controlling noise further comprises controlling the noise reduction transfer function according to a least mean square scheme based on the noise signal and the virtual error signal.

11. The method of claim 8, wherein controlling noise further comprises filtering the noise signal with a transfer function that models a transfer function of the secondary path prior to controlling the noise reduction transfer function.

12. The method of claim 8, wherein controlling noise further comprises filtering the noise signal with a transfer function that models a transfer function of the secondary path prior to the noise signal being filtered with the Green's function matrix.

13. The method of claim 8 further comprising detecting a position of a listener and controlling the Green's function matrix according to the detected position.

14. A system for generating a silent zone at a listening position, the system comprising:

a loudspeaker configured to radiate sound that corresponds to a sound signal;

an error microphone configured to pick up noise radiated by a noise source via a primary path to the listening position and the sound radiated by the loudspeaker via a secondary path to the listening position, and configured to generate a corresponding error signal;

a microphone array disposed above the listening position and configured to pick up noise radiated by a noise source via a primary path to the listening position and the sound radiated by the loudspeaker via a secondary path, the microphone array being configured to generate array signals; and a noise controller configured to receive a noise signal representative of noise radiated by the noise source and to filter the noise signal with a controllable noise reduction transfer function to generate the sound signal supplied to the loudspeaker, wherein the noise controller is further configured to:

control the noise reduction transfer function based on the noise signal and a virtual error signal, and generate the virtual error signal based on the error signal and the noise signal filtered with a Green's function matrix, the Green's function matrix being configured to be controlled by the array signals.

15. The system of claim 14, wherein the noise controller is further configured to subtract from the error signal the noise signal filtered with a Green's function matrix to generate the virtual error signal.

16. The system of claim 14, wherein the noise controller is further configured to control the noise reduction transfer function according to a least mean square scheme based on the noise signal and the virtual error signal.

17. The system of claim 14, wherein the noise controller is further configured to filter the noise signal with a transfer function that models a transfer function of the secondary path prior to the noise controller controlling the noise reduction transfer function.

18. The system of claim 14, wherein the noise controller is further configured to filter the noise signal with a transfer function that models a transfer function of the secondary path prior to the noise signal being filtered with the Green's function matrix.

19. The system of claim 14, further comprising a position detector configured to detect a position of a listener and to control the Green's function matrix according to the detected position.

20. The system of claim 14, wherein at least one of the loudspeaker or the error microphone is disposed in a headrest.

* * * * *